US005244543A

United States Patent [19]

Fry

[11] Patent Number: 5,244,543

[45] Date of Patent: Sep. 14, 1993

[54] BELT FILTER PRESS FABRIC

[75] Inventor: Ted Fry, Summerville, S.C.

[73] Assignee: Asten Group, Inc., Charleston, S.C.

[21] Appl. No.: 820,554

[22] Filed: Jan. 14, 1992

Related U.S. Application Data

[63] Continuation-in-part of Ser. No. 592,306, Oct. 3, 1990, Pat. No. 5,094,719.

[51] Int. Cl.[5] ..... D03D 15/00

[52] U.S. Cl. ..... 162/358.2; 139/383 A; 139/413; 139/420 R; 162/900

[58] Field of Search ..... 162/358, DIG. 1, 358.2, 162/900, 903; 428/258, 259; 139/383 A, 413, 420 R, 421, 423

[56] References Cited

U.S. PATENT DOCUMENTS

| | | | |
|---|---|---|---|
| 3,296,062 | 1/1967 | Truslow | 161/91 |
| 4,234,022 | 11/1980 | Okamoto et al. | 139/420 R |
| 4,289,173 | 9/1981 | Miller | 139/383 A |
| 4,370,375 | 1/1983 | Bond | 428/229 |
| 4,414,263 | 11/1983 | Miller et al. | 162/DIG. 1 |
| 4,438,788 | 3/1984 | Harwood | 162/DIG. 1 |
| 4,461,803 | 7/1984 | Booth et al. | 162/DIG. 1 |
| 4,555,410 | 11/1985 | Crook | 162/DIG. 1 |
| 4,555,440 | 11/1985 | Crook | 162/358 |
| 4,605,585 | 8/1986 | Johansson | 162/DIG. 1 |
| 4,815,499 | 3/1989 | Johnson | 162/DIG. 1 |
| 4,883,097 | 11/1989 | Dufour | 162/DIG. 1 |

*Primary Examiner*—Karen M. Hastings
*Attorney, Agent, or Firm*—Volpe and Koenig

[57] ABSTRACT

The present invention provides a belt filter press fabric for supporting pressing and draining moisture from a moisture laden web in a press having an inlet end, an outlet end and at least one high pressure nip. The fabric includes machine direction monofilament yarns having selected load bearing, dimensional stability and compressible characteristics. Means for protecting the machine direction yarns from compressive deterioration, such as fibrillation, are provided by interweaving the machine direction yarns with cross machine direction yarns the majority of which have a compressibility characteristic which is greater than the characteristic of the machine direction yarns.

21 Claims, 2 Drawing Sheets

BELT FILTER PRESS FABRIC

This application is a continuation-in-part of my copending application for Belt Filter Press Fabric, Ser. No. 07/592,306 filed Oct. 3, 1990 which is now U.S. Pat. No. 5,094,719 issued Mar. 10, 1992.

BACKGROUND OF THE INVENTION

1. Field of the Invention

The present invention relates: generally to press fabrics which are used in industrial filtration processes; more specifically to fabrics which are utilized in presses which apply roller nip pressure to the fabric and the product; and most particularly to fabrics which are used in high nip pressure presses which produce paper pulp as an intermediary product in the papermaking process.

In a typical process, water laden pulp is presented to the press for dewatering. The pulp slurry as presented to the press must be dewatered to increase the consistency of the slurry by about 20 to 25 times. Typically, the press is about 80 inches wide, however, units having a width of about 136 inches are known. The typical press has opposed fabrics mounted in an endless fashion about a series of rollers. Some of the rollers are opposed and form a roller nip which presses the fabrics and the product. Pressure nips of about 300 pli are known, however, lower nip pressures are more typical.

One proposed unit is expected to dewater a pulp slurry having a Ph between 6.0 and 7.0 and a minimum freeness of about 550 CSF (Canadian Standard Freeness). The slurry inlet consistency is expected to be about 1.5% solids and the outlet consistency is projected at about 35% solids. Projected operating speeds for the unit are up to 165 feet per minute. The unit is expected to have nip pressures approaching 460 pli. The unit fabric width is expected to exceed twice the typical width of about 80 inches. Thus, the proposed unit will utilize a fabric width and high nip pressures which exceed known units. In fact, nip pressures of over 400 pli are not believed to have been known in the prior art. The prior art fabrics are not suitable for pulp units having high nip pressures which exceeded 300 pli.

As a result of the above, it was recognized that the industry required a belt filter press fabric which was capable of maximizing service life, drainage, fiber retention and wear characteristics. Additionally, it was recognized that the preferred fabric should provide optimal performance with respect to fabric cleaning and sheet release properties.

In view of the above, it was recognized that the yarns comprising the belt filter press fabric had to be selected for certain wear characteristics and it needed to be configured in a structure which provided additional wear characteristics as a result of that construction.

2. Description of the Prior Art

In the prior art of papermaking fabrics, it has been recognized that papermakers fabrics may be made from combinations of yarns which impart separate characteristics to the fabric. One example of such a fabric is disclosed in U.S. Pat. No. 4,289,173. This patent discloses the use of separate yarns of different materials in order to obtain different properties, preferably improved wear resistance, and dimensional stability in a formation fabric. U.S. Pat. No. 4,289,173 is concerned with a papermakers forming fabric and does not relate to the problems associated with press fabrics that are subjected to the high nip pressure associated with the present invention. As will be known to those skilled in the art, the formation process, except in the case of twin wire formation, is generally an open process which does not employ opposed belts or nip pressures. The twin wire process does not utilize nip rollers and the only pressure is that resulting from the positioning of the opposed belts relative to each other.

SUMMARY OF THE INVENTION

The present invention provides a belt filter press fabric for supporting pressing and draining moisture from a moisture laden web in a press having an inlet end, an outlet end and at least one high pressure nip. The fabric which may be woven endless and/or include a seam, has a body which is comprised of machine direction monofilament yarns having selected load bearing, dimensional stability and compressibility characteristics interwoven with cross machine direction yarns the majority of which have a compressive characteristic which is greater than the compressive characteristic of the machine direction yarns. The interwoven cross machine direction yarns constitute means for protecting the machine direction yarns from compressive deterioration, such as fibrillation, when the fabric transports the aqueous web through the high pressure nip.

DESCRIPTION OF THE PREFERRED EMBODIMENTS

Figure 1:
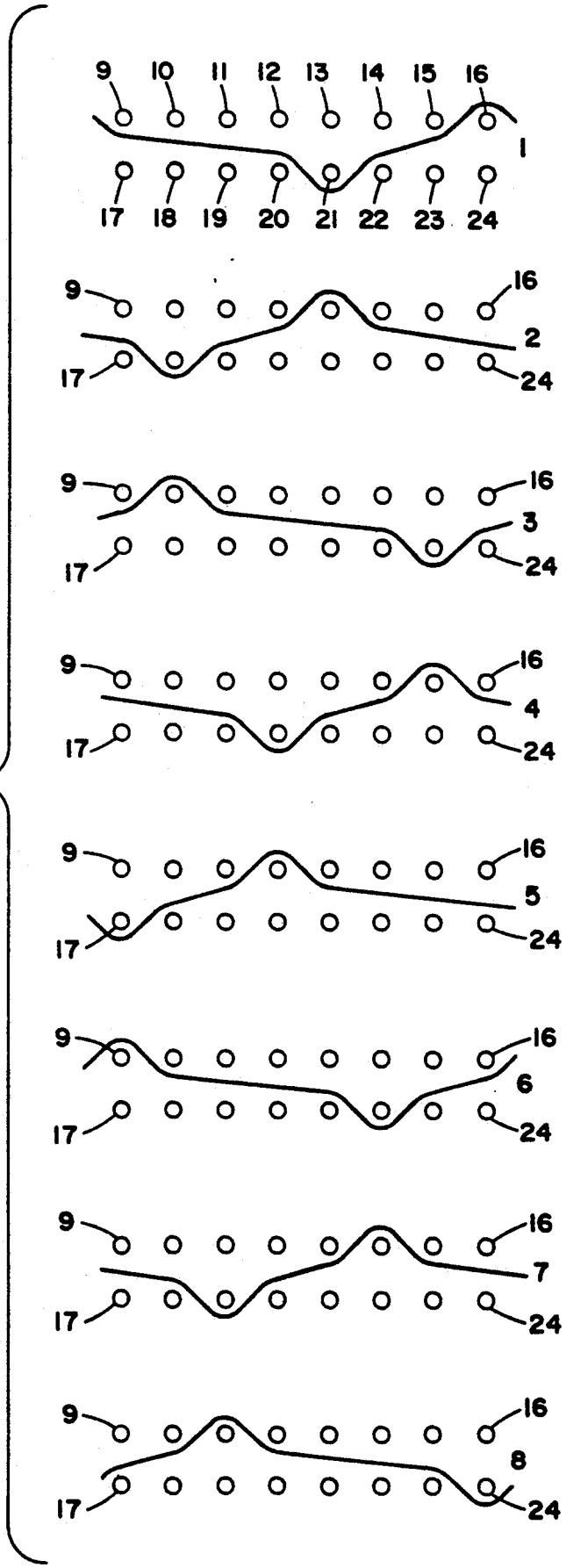
FIG. 1 is an exploded view of one repeat of a two ply fabric in accordance with the present invention.

While it is believed that the preferred two ply construction provides additional benefits, the invention is not limited to a specific weave construction. As a result of analysis of prior art fabrics, it was concluded that the prior art constructions were unsuitable for press applications where nip pressures exceeded 300 pli because of the yarns selected for use in the machine and cross machine directions. From the analysis of prior fabrics, it was concluded that the prior fabrics were utilizing polyester (PET) and/or nylon in both the machine and cross machine direction. As a result, the prior art fabrics were subject to a number of yarn failures and yarn fibrillation. Yarn fibrillation is a condition where the yarn, due to the pressure and the harsh environment, begins to lose its monofilament characteristic and shreds into a number of individual fiber like elements. Once the yarn has become fibrillated, it is more susceptible to the high pressures and the harsh environment and the degeneration of the yarn, and consequently, the fabric is accelerated. It was concluded that the prior art fabrics lacked the required compressibility to resist the repeated passes through the high pressure nips. Based upon the above observations, it was concluded that an improved fabric must have increased pressure absorption capacity and compressibility. In general, compressibility may be defined as the ability to repeatedly absorb pressure applied perpendicular to the yarn axis and to rebound upon release of that pressure without creating yarn fatigue and/or fibrillation. It has been generally observed that monofilaments with greater elasticity have greater pressure absorption capacity, however, these results have been observed empirically and it is unknown whether these observations may be correlated by any standard testing method. Furthermore, sufficient field experience has not been available to quantitatively correlate the relationship between elasticity with field performance in an application requiring a compressible yarn.

Nylon monofilament, such as nylon 6, 10 or nylon 6, 6 monofilament, available from Asten Monotech, Inc., Summerville, S.C. and (PBT) polyester monofilament, available from Glass Master Inc., Lexington, S.C., are suitable high compression yarns. It has also been found that the nylon and (PBT) polyester may be used in the same fabric. Preferably, the high compression yarns are used in the cross machine direction while utilizing flat shaped polyester (PET) monofilament in the warp direction.

Additional high compression yarns available from Asten Monotech, Inc. include yarns made from polyphthalamide, such as Amoco's Amodel TM and yarns made from a partially aromatic polyamide such as BASF Ultramid. Hoechst Celanese Corporation's Polymer 'D', a proprietary polyester (PET) alloy, yarn and other polyester (PET) alloy yarns such as 90% PET with 10% MXDA6 (metaxylenediamine), available from Glass Master Inc., are also suitable.

In general, it appears that the benefits of the invention may be achieved by utilizing warp yarns which have a lower compressibility but are matched to the fabric requirements for load bearing, sometimes referred to as yarn tenacity and dimensional characteristics in combination with higher compression cross machine direction yarns that are interwoven with long floats that shield the warp or machine direction yarns. The more compressible cross machine direction yarns do not require the load bearing or dimensionally stable characteristic associated with the machine direction yarns. The more compressible yarns may even be deformable under pressure perpendicular to the yarn axis which is applied by hand. All of the cross machine direction yarns selected for their compressive characteristics will be capable of undergoing temporary deformation under pressure.

In the preferred two ply construction, the cross machine direction yarns absorb the shock of the nip and isolate the load bearing machine direction yarns from wear by both the product and the machine. The ability to cushion the load bearing machine direction yarns helps to avoid fibrillation and therefore extends fabric life.

As can be seen from the above, the machine direction yarns of the fabric must be selected so as to meet the load bearing criteria of the fabric and to impart the initial fabric stability. The cross machine direction yarns must be selected so as to impart the desired compressibility to the fabric while recognizing the continued need for fabric stability. The weave construction must be selected so as to optimize the protection of the machine direction yarns while retaining the advantages associated with the more compressible yarn.

As a result of analyzing the criteria, it has been determined that the preferred construction is a two ply cross machine direction construction having a single ply of machine direction yarns which are interwoven with machine direction intermediary floats. In order to further increase fabric stability, it was concluded that the machine direction yarns should have a flattened profile which yields a generally rectangular cross section. The utilization of flat machine direction yarns increases the contact area between the machine direction yarn and the cross machine direction yarns. This permits an enlarged contact area between the two systems of yarns and adds dimensional stability. In addition, the flattened profile creates an additional area of contact between the cross machine and machine direction yarns which improves distribution of the nip pressure. It is believed that the improved distribution and contact profile between the machine direction and cross machine direction yarns enhance the compressive effect of the cross machine direction yarns. In addition to this enhancement, the increased contact area permits longer floats in the cross machine direction.

On appearance alone, one would suspect that a two ply fabric may not provide adequate drainage capacity, however, experience dictates otherwise. Two ply fabrics utilizing flattened monofilaments exhibit adequate drainage capacity along with improved fiber support for better sheet formation.

As noted previously, the preferred construction for the present fabric is a two ply construction having cross machine direction floats. The preferred construction is shown in FIG. 1. In the construction Of FIG. 1, there are eight machine direction yarns, 1 through 8, per repeat and sixteen cross machine direction yarns, 9 through 24, in two plies. As can be seen from FIG. 1, the cross machine direction yarns 9 through 16 form an upper ply or first ply and cross machine direction yarns 17 through 24 form a second or lower ply. Each of the machine direction yarns 1 through s is interwoven with selected cross machine direction yarns 9 through 24 to produce a single machine direction knuckle in each cross machine direction ply. Accordingly, yarn 1 passes over cross machine direction yarn 16 to form an upper ply knuckle and beneath cross machine direction yarn 21 to form a lower ply knuckle. With the exception of those two interlacings, the machine direction yarn 1 floats internally between the upper and lower plies. By examining each of the individual weave patterns of FIG. 1 for yarns 2 through 8, it can be seen that the machine direction yarns only interweave with one upper ply and one lower ply cross machine direction yarn within a repeat. Likewise, it can be seen that no two machine direction yarns interweave with the same cross machine direction yarn within a repeat. Accordingly, each cross machine direction yarn will have a float length which is equal to seven machine direction yarns. While longer float lengths are preferred, it will be understood that the term float generally refers to lengths equal to two or more adjacent machine direction yarns.

Figure 2:
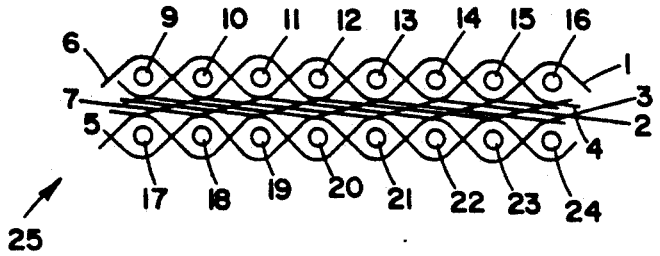
FIG. 2 is an illustrative section of one repeat of the fabric shown in FIG. 1.

With reference to FIG. 2, it is possible to see the full construction of a single repeat wherein the machine direction yarns float between the cross machine direction plies. As will be known to those skilled in the art, the construction shown in FIGS. 1 and 2 will repeat on eight warp yarns and sixteen cross machine direction yarns. In the construction illustrated in FIGS. 1 and 2, the weave is a broken pattern which repeats on eight ends and all machine direction yarns have the same crimp pattern.

In the preferred embodiment of FIGS. 1 and 2 the odd number cross machine direction yarns 9, 11, 13, 15, 17, 19, 21, and 23 are monofilaments of nylon 610 with a circular configuration having a diameter of about 0.48 mm; the even number cross machine direction yarns 10, 12, 14, 16, 18, 20, 22, and 24 are (PBT) polyester monofilament with a circular configuration having a diameter of about 0.4 mm. The machine direction yarns 1 through 8 are polyester (PET) flatten monofilament having a horizontal axis of approximately 0.6 mm and a vertical axis of approximately 0.38 mm. The fabric was woven with fifty-two ends per inch in the machine direction and forty-eight picks per inch in the cross machine direction. The caliper of the fabric was approximately 0.07 inches and the air flow as measured on a Fraizer Air Permeability Tester was approximately 500 cfm.

As can been seen from the above, the nylon 610 and (PBT)polyester monofilaments were alternated across the width of the fabric and were vertically oriented in the two plies. If desired, the cross machine direction yarns may be alternated in other patterns, such as diagonally, so long as the fabric remains substantially balanced. Likewise, the cross machine direction yarns, may be of a single material. Still further, certain of the cross machine direction yarns may be selected to impart other desirable characteristics to the fabric. At present, it is expected that highly compressible filaments will comprise at least sixty percent and most probably will comprise at least seventy-five percent of the cross machine direction yarns when different yarns are used in the cross machine direction, it is expected that they will be woven in a specified repeat pattern throughout the fabric. In all cases, the number or percentage of cross machine direction monofilaments having the desired compressive characteristics will be such that they dominate the cross machine direction.

Figure 3:
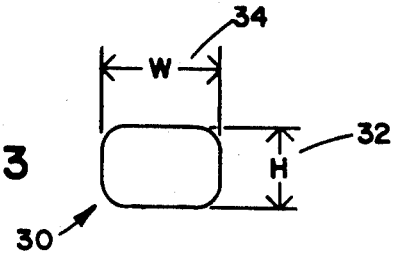
FIG. 3 is an illustrative section through the preferred warp yarns of the fabric shown in FIGS. 1 and 2.

With reference to FIG. 3, there is illustrated a typical cross section for the flat monofilament employed in the warp of the preferred embodiments of the present invention. The flat monofilament 30 has a vertical axis or height dimension 32 which is less than the horizontal axis or width dimension 34. In the preferred embodiments, the ratio of the width 34 to the height 32 is a least 1.5 to 1.

Figure 4:
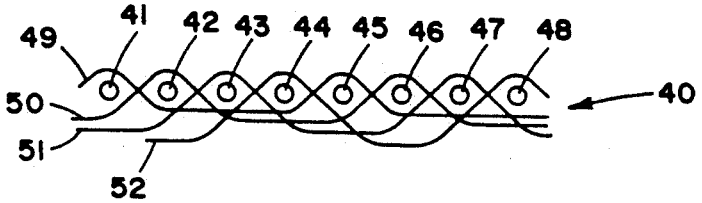
FIG. 4 is a section cut of a single ply fabric in accordance with the invention.

With reference to FIG. 4, there is illustrated a single ply construction in accordance with the present invention. As will be known to those skilled in the art, the warp yarns 49 through 52 are weaving in an under 3/1 repeat pattern. For the purpose of comparison with the prior embodiment, eight machine direction yarns 41 through 48 are illustrated in FIG. 4. However, it will be recognized that only four machine direction yarns will be required to complete the repeat. Likewise, it will be recognized that the cross machine direction yarns are weaving in a ⅛ repeat pattern. As in the prior construction, cross machine direction yarns 41 through 48 are selected for their compressibility and may be alternated in accordance with the prior discussion.

Still with reference to FIG. 4, it will be recognized that the single ply construction does not permit the machine direct ion yarns 49 through 52 to be fully shielded by the cross machine direction yarns. Since one of the primary advantages to the present invention is the utilization of differential yarns for the purpose of obtaining the desired compressibility, the machine side surface of the construction depicted in FIG. 4 will ultimately be determined by the running characteristics of the apparatus on which the fabric is installed. As a result of the unbalanced float configuration, it is generally expected that the cross machine direction floats will be applied as the machine side surface. In such an application, the cross machine direction floats will be in contact with the various rollers and will be exposed to the machine side pressures exerted in the nips of the press.

Figure 5:
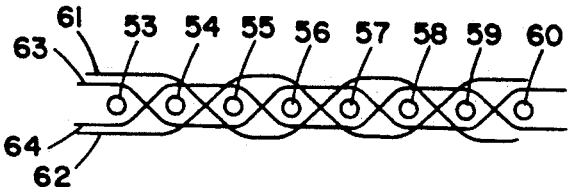
FIG. 5 is a section cut of another single ply fabric in accordance with the invention.

With reference to FIG. 5, there is illustrated an alternative single ply construction in accordance with the present invention. As will be known to those skilled in the art, the Warp yarns 61, 62, 63 and 64 are weaving in a 2/2 repeat pattern. For the purpose of comparison with prior constructions, eight machine direction yarns 53 through 60 are illustrated in FIG. 5. It will be recognized by those skilled in the art that the single ply construction of FIG. 5 is a balanced weave. The warps 61 through 64 have equal float lengths on both surfaces of the fabric. Similarly, the cross machine direction floats will be balanced.

As will be recognized by those skilled in the art, fabrics manufactured using synthetic materials are generally heat set to establish the desired crimp interchange and to further stabilize the fabric configuration. In a construction such as t hat shown in FIGS. 1 and 2, the fabric will be heat set in accordance with a heat set temperature based upon the tenacity of the machine direction yarns which was selected in accordance with the application and load bearing requirements. Since the construction of the two ply fabric results in the floats of the machine direction yarns being protected, the fabric will be heat set to establish a crimp interchange between the machine and cross machine direction yarns and to reduce or straighten the crimp in the machine direction yarns. In this manner, the cross machine direction yarns will clearly dominate both surfaces of the fabric and the machine direction yarns will have minimum contact with the machine rollers and/or the product being dried.

In single layer constructions such as FIGS. 4 and 5, the machine direction yarns are heat set under temperatures and tensions which reduce machine direction crimp so that the cross machine direction yarns will be dominant and bear the load. The construction of FIG. 4, due to its unbalanced surfaces, will, in all likelihood, be heat set under higher tensions than a balanced weave to achieve the cross machine yarn dominance. With a construction such as that in FIG. 4, the cross machine direction floats are generally presented as the contact surface for machine direction rollers and the machine direction surfaces generally presented as the product surface since the pulp will have a cushioning effect during compaction. It is presently contemplated, in all construction, that the highly compressive yarns will dominate the surface of the fabric which is exposed as the machine running surface. In this way it is possible to utilize the product as part of the cushioning effect during operation of the pulp press. Since the fabrics are generally run in opposed fashion, this will result in high compression yarns being presented to all machine surfaces as a first means of shock absorbency and the pulp being utilized as a second means of shock absorbency.

Likewise, it is expected in all configurations that the machine direction yarns will be selected with a tenacity necessary for the running and the load characteristics of the application. As a unbalanced float configuration, it is generally expected that the cross machine direction floats will be applied as the machine side surface. In such an application, the cross machine direction floats will be in contact with the various rollers and will be exposed to the machine side pressures exerted in the nips.

Figure 6:
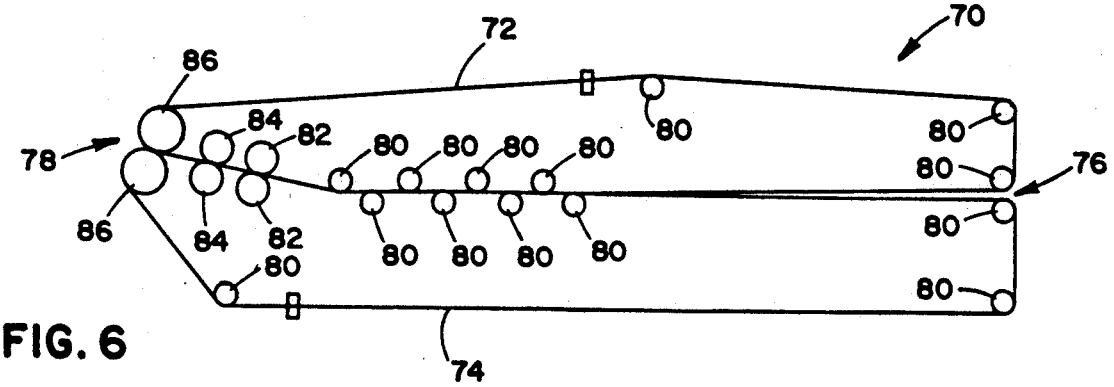
FIG. 6 is a side elevation of a typical pulp press of the type which may benefit from utilization of the present invention.

With reference to FIG. 6, there is illustrated a typical press 70 utilizing an upper fabric 72 and a lower fabric 74. The press 70 has an inlet 76 and an outlet 78. The fabrics 72 and 74 are mounted about a plurality of rollers 80, 82, 84 and 86 which define the inlet opening 76 and the gradual closing of that opening as it approaches the outlet 78. Approximate to the outlet 78 opposed rollers 82, 84 and 86 define three press nips. The nip pressure at the rollers 82 will be approximately 285 pli; the nip pressure at the rollers 84 will be approximately 345 pli; and, the nip pressure at the rollers 86 will be approximately 460 pli. In one known apparatus, the nip rollers 86 also drive the fabric. In an apparatus where the nip rollers also drive the fabric, the fabric at that point is subject to a vertical force vector at the nip and a generally horizontal vector extending toward the outlet 78.

In the operation of a pulp press, the pulp slurry enters the press 70 at inlet 76 and is dewatered and condensed as it approaches outlet 78. The pulp, as it approaches outlet 78 has been dewatered and condensed to a consistency which is some 20 to 25 times the consistency of the slurry as it enters inlet 76.

At present, it is expected that both fabric 72 and 74 will be in accordance with the present invention, however, some of the advantages of the invention may be obtained through the use of a single fabric.

What I claim is:

1. The combination of a pulp press having an inlet end, an outlet end and at least one high pressure nip of at least 300 pli and a belt filter press fabric having a pulp carrying side for supporting and transporting a pump slurry through the high pressure nip, wherein said filter fabric includes a body consisting essentially of:

a single ply of synthetic monofilament machine direction yarns having selected load bearing and compressive characteristics; and means for protecting said machine direction yarns from compressive deterioration as said fabric travels through the high pressure nip of the pulp press including;

a system of synthetic monofilament cross machine direction yarns at least the majority of which have a compressive characteristic which is greater than the compressive characteristic of said machine direction yarns; and said cross machine direction yarns selectively interwoven with said machine direction yarns in a repeat pattern such that the cross machine direction yarns float over at least three adjacent machine direction yarns in each repeat to thereby define a machine contact surface of the fabric such that the cross machine direction floats come in contact with the pulp press as the fabric transports the pulp slurry therethrough.

2. The combination of claim 1 wherein said machine direction monofilament yarns have a generally rectangular cross section.

3. The combination of claim 1 wherein all of the cross machine direction yarns have a compressive characteristic greater than that of the machine direction yarns.

4. The combination of claim 3 wherein all of the cross machine direction yarns have the same compressive characteristic.

5. The combination of claim 1 wherein the cross machine direction yarns having a compressive characteristic which is greater than the compressive characteristic of the machine direction yarns comprise at least sixty percent of the cross machine direction yarns.

6. The combination of claim 1 wherein the cross machine direction yarns having a compressive characteristic which is greater than the compressive characteristic of the machine direction yarns comprise at least seventy-five percent of the cross machine direction yarns.

7. The combination of claim 1 wherein the cross machine direction yarns having a compressive characteristic which is greater than the compressive characteristic of the machine direction yarns are made of a material selected from the group consisting of nylon, polyphthalamide, polyester (PET) alloy sold under the trade name Hoechst Celanese Polymer 'D', an alloy of 90% polyester (PET) and 10% metaxylenediamine, partially aromatic polyamide, and (PBT) polyester.

8. The combination of claim 7 wherein the machine direction yarns are comprised of (PET) polyester.

9. The combination of claim 7 wherein the machine direction yarns have a rectangular cross section.

10. The combination of claim 7 wherein the cross machine direction yarns dominate both surfaces of the fabric.

11. A belt filter press fabric for supporting, pressing and draining moisture from a pulp slurry in a pulp press having an inlet end, an outlet end and at least one high pressure nip, said filter fabric having a body consisting essentially of:

a single ply of synthetic monofilament machine direction yarns having selected load bearing and compressive characteristics, and means for protecting said machine direction yarns from compressive deterioration at nip pressures in a pulp press greater than 300 pli including:

a system of synthetic monofilament cross machine direction yarns at least the majority of which have a compressive characteristic which is greater than the compressive characteristic of said machine direction yarns; and said cross machine direction yarns selectively interwoven with said machine direction yarns in a repeat pattern such that the cross machine direction yarns float over at least three adjacent machine direction yarns in each repeat to thereby define a machine contact surface of the fabric.

12. The fabric of claim 11 wherein said machine direction monofilament yarns have a generally rectangular cross section which is 0.38 mm by 0.6 mm and the cross machine direction yarns are 0.5 mm in diameter.

13. The fabric of claim 11 wherein the cross machine direction yarns weave in two piles, the cross machine direction yarns of each ply woven in floats on a surface of the fabric and the machine direction yarns extend between the two piles of cross machine direction yarns.

14. The fabric of claim 11 wherein the machine direction monofilament yarns have a major to minor axis ratio of at least 1.5:1.

15. The fabric of claim 11 wherein:

the cross machine direction yarns having a compressive characteristic which is greater than the compressive characteristic of the machine direction yarns are made of a material selected from the group consisting of nylon, polyphthalamide, polyester (PET) alloy sold under the trade name Hoechst Celanese Polymer, 'D', an alloy of 90% polyester (PET) and 10% metaxylenediamine, partially aromatic polyamide, and (PBT) polyester; and wherein the machine direction yarns are made of polyester (PET).

16. The combination of a pulp press having an inlet end, an outlet end and at least one high pressure nip of at least 300 pli and a belt filter press fabric having a pulp carrying side for supporting and transporting a pump slurry through the high pressure nip, wherein said filter fabric includes a body consisting essentially of:

a single ply of synthetic monofilament machine direction yarns having selected load bearing and compressive characteristics; and means for protecting said machine direction yarns from compressive deterioration as said fabric travels through the high pressure nip of the pulp press including;

a system of synthetic monofilament cross machine direction yarns at least the majority of which have a compressive characteristic which is greater than the compressive characteristic of said machine direction yarns;

said cross machine direction yarns selectively interwoven with said machine direction yarns in a repeat pattern such that said cross machine direction yarns weave in two piles with the machine direction yarns extending between the two piles of cross machine direction yarns; and each ply of cross machine direction yarns woven in floats on a surface of the fabric to thereby respectively define a slurry-carrying surface and a machine contact surface of the fabric such that the cross machine direction floats of the machine contact surface come in contact with the pulp press as the fabric transports the pulp slurry therethrough.

17. The combination of claim 16 wherein the cross machine direction yarns having a compressive characteristic which is greater than the compressive characteristic of the machine direction yarns are made of a material selected from the group consisting of nylon, polyphthalamide, polyester (PET) alloy sold under the trade name Hoechst Celanese Polymer 'D', an alloy of 90% polyester (PET) and 10% metaxylenediamine, partially aromatic polyamide, and (PBT) polyester.

18. The combination of claim 16 wherein said machine direction yarns have a generally rectangular cross section.

19. A belt filter press fabric for supporting, pressing and draining moisture from a pulp slurry in a pulp press having an inlet end, an outlet end and at least one high pressure nip, said filter fabric having a body consisting essentially of:

a single ply of synthetic monofilament machine direction yarns having selected load bearing and compressive characteristics, and means for protecting said machine direction yarns from compressive deterioration at nip pressures in a pulp press greater than 300 pli including:

a system of synthetic monofilament cross machine direction yarns at least the majority of which have a compressive characteristic which is greater than the compressive characteristic of said machine direction yarns;

said cross machine direction yarns selectively interwoven with said machine direction yarns in a repeat pattern such that the cross machine direction yarns weave in two piles with the machine direction yarns extending between the two piles of cross machine direction yarns; and each ply of cross machine direction yarns woven in floats on a surface of the fabric to thereby respectively define a slurry-carrying surface and a machine contact surface of the fabric such that the cross machine direction floats of the machine contact surface come in contact with the pulp press as the fabric transports the pulp slurry therethrough.

20. The fabric of claim 19 wherein:

the cross machine direction yarns having a compressive characteristic which is greater than the compressive characteristic of the machine direction yarns are made of a material selected from the group consisting of nylon, polyphthalamide, polyester (PET) alloy sold under the trade name Hoechst Celanese Polymer 'D', an alloy of 90% polyester (PET) and 10% metaxylenediamine, partially aromatic polyamide, and (PBT) polyester; and the machine direction yarns are made of polyester (PET).

21. The fabric of claim 20 wherein said machine direction yarns have a generally rectangular cross section.

* * * * *

UNITED STATES PATENT AND TRADEMARK OFFICE

CERTIFICATE OF CORRECTION

PATENT NO. : 5,244,543

DATED : September 14, 1993

INVENTOR(S) : Ted Fry

It is certified that error appears in the above-identified patent and that said Letters Patent is hereby corrected as shown below:

At column 4, line 28, delete "Of" and insert therefor --of--

At column 4, line 35, delete "yarns 1 through s" and insert therefor --yarns, 1 through 8--

At column 5, line 60, delete "direct ion" and insert therefor -direction--.

At column 6, line 10, delete "Warp" and insert therefor --warp--

At column 6, line 23, delete "t hat" and insert therefor --that--

In claim 19, at column 10, line 22, delete "the" and insert therefor --said--

Signed and Sealed this

Twenty-second Day of March, 1994

*Attest:*

Bruce Lehman

BRUCE LEHMAN

*Attesting Officer*

*Commissioner of Patents and Trademarks*